US005463871A

United States Patent [19]

Cheung

[11] Patent Number: 5,463,871

[45] Date of Patent: Nov. 7, 1995

[54] SIDE COLUMN CRYOGENIC RECTIFICATION SYSTEM FOR PRODUCING LOWER PURITY OXYGEN

[75] Inventor: Harry Cheung, Williamsville, N.Y.

[73] Assignee: Praxair Technology, Inc., Danbury, Conn.

[21] Appl. No.: 317,973

[22] Filed: Oct. 4, 1994

[51] Int. Cl.[6] ..... F25J 3/02

[52] U.S. Cl. ..... 62/38; 62/25; 62/31

[58] Field of Search ..... 62/24, 25, 31, 62/38

[56] References Cited

U.S. PATENT DOCUMENTS

| | | | |
|---|---|---|---|
| 2,664,719 | 1/1954 | Rice et al. | 62/25 |
| 2,873,583 | 2/1959 | Potts et al. | 62/25 X |
| 3,113,854 | 12/1963 | Bernstein | 62/28 |
| 4,224,045 | 9/1980 | Olszewski et al. | 62/38 X |
| 4,410,343 | 10/1983 | Ziemer | 62/29 |
| 4,560,398 | 12/1985 | Beddome et al. | 62/29 |
| 4,617,036 | 10/1986 | Suchdeo et al. | 62/24 X |
| 4,702,757 | 10/1987 | Kleinberg | 62/24 |
| 4,769,055 | 9/1988 | Erickson | 62/22 |
| 4,895,583 | 1/1990 | Flanagan | 62/24 |
| 4,936,099 | 6/1990 | Woodward et al. | 62/24 |
| 5,006,139 | 4/1991 | Agawal et al. | 62/24 |
| 5,036,672 | 8/1991 | Rottmann | 62/24 |
| 5,129,932 | 7/1992 | Agrawal et al. | 62/31 X |
| 5,233,838 | 8/1993 | Howard | 62/25 |
| 5,245,832 | 9/1993 | Roberts | 62/24 |
| 5,265,429 | 11/1993 | Dray | 62/41 |
| 5,337,570 | 8/1994 | Prosser | 62/38 X |
| 5,341,646 | 8/1994 | Agrawal et al. | 62/25 |
| 5,386,691 | 2/1995 | Bonaquist et al. | 62/38 X |
| 5,392,609 | 2/1995 | Girault et al. | 62/25 |

*Primary Examiner*—Christopher B. Kilner
*Attorney, Agent, or Firm*—Stanley Ktorides

[57] ABSTRACT

A cryogenic rectification system employing a double column and an auxiliary side column in which product lower purity oxygen is produced wherein the side column is driven by condensing compressed feed air enabling the system to operate with lower head pressure and thus lower operating costs.

9 Claims, 4 Drawing Sheets

SIDE COLUMN CRYOGENIC RECTIFICATION SYSTEM FOR PRODUCING LOWER PURITY OXYGEN

TECHNICAL FIELD

This invention relates generally to cryogenic rectification and more particularly to the production of lower purity oxygen.

BACKGROUND ART

The cryogenic separation of air is a well established industrial process. Cryogenic air separation involves the filtering of the feed air to remove particulate matter and compression of that feed air to supply the energy required for separation. Following the compression the feed air is cleaned of high boiling impurities such as carbon dioxide and water vapor, cooled, and then separated into products by cryogenic rectification. The separation columns are operated at cryogenic temperatures to allow the gas and liquid contacting necessary for separation by distillation, and the separated products are then returned to ambient temperature conditions against the cooling feed air stream.

The most common cryogenic air separation system for the production of oxygen is the double column system which employs a higher pressure column and a lower pressure column in heat exchange relation at a main condenser. In this system the head pressure is the pressure discharge at the base load air compressor which is set by the pressure at the bottom of the higher pressure column plus the pressure drop in piping and apparatus between the base load air compressor and the higher pressure column. In turn, the pressure at the bottom of the higher pressure column is set by the pressure drop of the stream from the top of the lower pressure column to the atmosphere, by the added pressure difference to the bottom of the lower pressure column, by the temperature difference across the main condenser which sets the high pressure nitrogen condensing pressure at the top of the higher pressure column, and by the added pressure drop to the bottom of the higher pressure column. In conventional systems the pressure at the bottom of the higher pressure column is generally within the range of from 70 to 80 pounds per square inch absolute (psia) resulting in a head pressure generally within the range of from 77 to 87 psia.

The conventional double column system enables the separation of air with good energy efficiency and excellent product purity. However, when lower purity oxygen, i.e. oxygen having a purity of 99 mole percent or less, is desired, the conventional system is less efficient because it has more air separation capability than is being utilized. Since the demand for lower purity oxygen is increasing in applications such as glassmaking, steelmaking and energy production, it is desirable to have a double column system which can produce lower purity oxygen at lower operating costs.

Accordingly, it is an object of this invention to provide an improved double column cryogenic rectification system for producing lower purity oxygen.

SUMMARY OF THE INVENTION

The above and other objects which will become apparent to one skilled in the art upon a reading of this disclosure are attained by the present invention, one aspect of which is:

A cryogenic rectification method for producing lower purity oxygen comprising;

(A) compressing feed air;

(B) at least partially condensing compressed feed air and passing the resulting feed air into the higher pressure column of a double column which also includes a lower pressure column;

(C) passing crude liquid oxygen comprising from 50 to 88 mole percent oxygen from the lower pressure column into a side column;

(D) separating the crude liquid oxygen by cryogenic rectification within the side column into oxygen product fluid and remaining vapor;

(E) passing remaining vapor from the side column into the lower pressure column;

(F) at least partially vaporizing the oxygen product fluid by indirect heat exchange with the compressed feed air to carry out the said at least partial condensation of the compressed feed air; and (G) recovering oxygen product fluid as product lower purity oxygen having an oxygen concentration which exceeds that of the crude liquid oxygen.

Another aspect of the invention is:

A cryogenic rectification apparatus comprising:

(A) a base load feed air compressor;

(B) a side column having a bottom reboiler;

(C) a double column including a first column and a second column;

(D) means for passing feed air from the base load feed air compressor to the bottom reboiler and from the bottom reboiler into the first column;

(E) means for passing fluid from the lower portion of the second column into the side column;

(F) means for passing fluid from the side column into the second column; and (G) means for recovering product from the side column.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein the term "bottom reboiler" means a heat exchange device which generates column upflow vapor from column bottom liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "feed air" means a mixture comprising primarily nitrogen and oxygen, such as ambient air.

As used herein the term "lower purity oxygen" means a fluid having an oxygen concentration of 99 mole percent or less.

DETAILED DESCRIPTION

In general, the invention enables the higher pressure column of the double column system to operate at lower pressure by uncoupling the dependence of the pressure at the bottom of the higher pressure column to the oxygen product purity. Thus the invention achieves energy savings by reducing the feed air compression work required to achieve the requisite head pressure.

The invention will be described in detail with reference to the Drawings.

Figure 1:
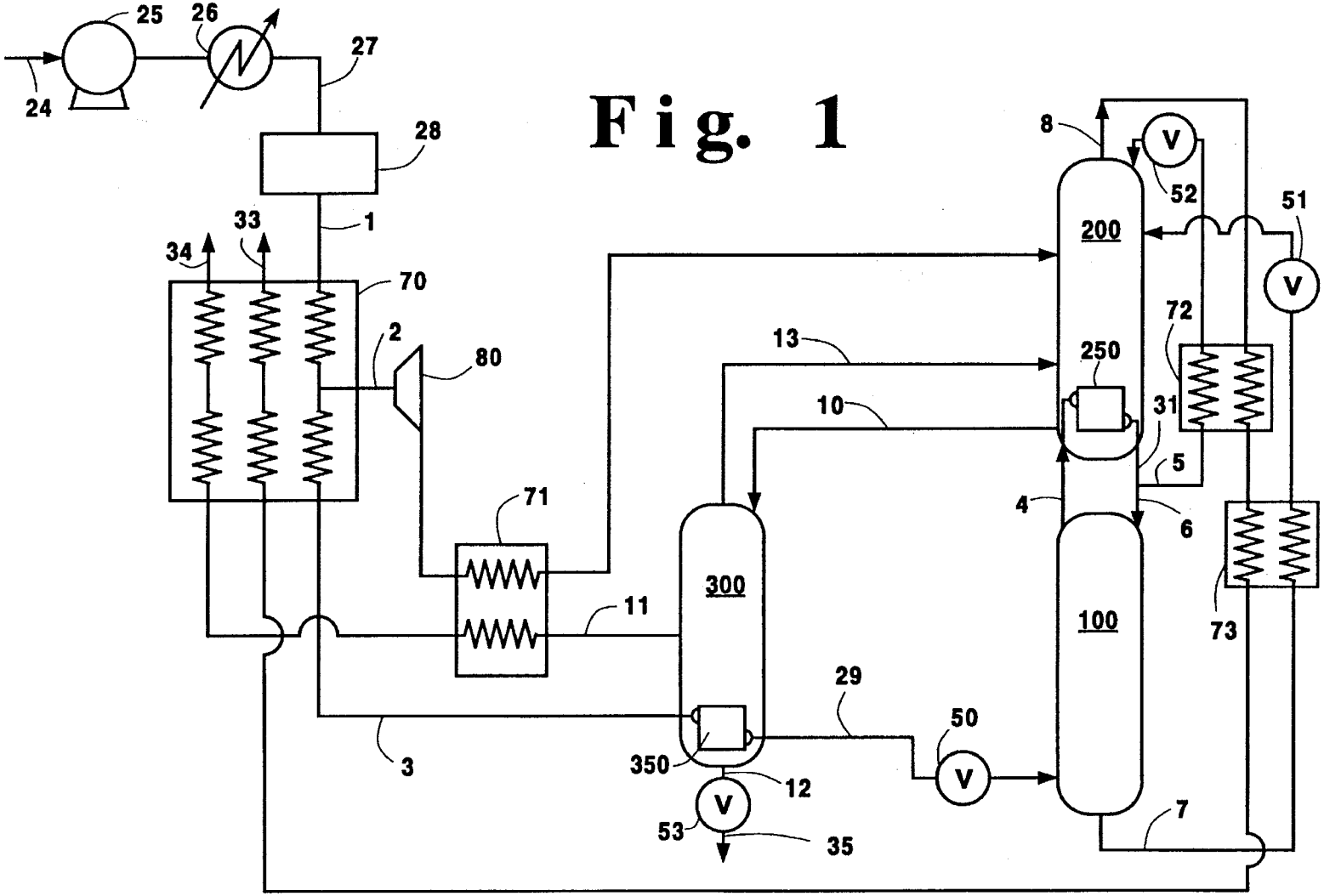
FIG. 1 is a schematic representation of one preferred embodiment of the cryogenic rectification system of this invention.

Referring now to FIG. 1, feed air 24 is compressed by passage through base load feed air compressor 25 to a pressure generally within the range of from 38 to 65 psia and then cooled by passage through cooler 26 to remove heat of compression. Thereafter the pressurized feed air 27 is cleaned of high boiling impurities, such as water vapor and carbon dioxide, by passage through purifier 28 and resulting feed air stream 1 is cooled by indirect heat exchange with return streams in main heat exchanger 70. A minor portion 2, generally comprising from 10 to 25 percent of total feed air, is turboexpanded through turboexpander 80 to generate refrigeration, further cooled by passage through heat exchanger 71 and passed into lower pressure column 200.

Portion 3, generally comprising from 75 to 90 percent of the feed air, is passed through bottom reboiler 350 which is usually located within side column 300 in the lower portion of this column. Within bottom reboiler 350 the compressed feed air is at least partially condensed and thereafter the resulting feed air stream 29 is passed through valve 50 and into higher pressure column 100.

Higher pressure column 100 is the first or higher pressure column of the double column which also comprises second or lower pressure column 200. Higher pressure column 100 operates at a pressure generally within the range of from 30 to 60 psia. Within higher pressure column 100 the feed air is separated by cryogenic rectification into nitrogen-enriched vapor and oxygen-enriched liquid. Nitrogen-enriched vapor is passed in stream 4 to main condenser 250 wherein it is condensed by indirect heat exchange with lower pressure column 200 bottom liquid. Resulting nitrogen-enriched liquid 31 is divided into streams 6 and 5. Stream 6 is passed into column 100 as reflux and stream 5 is cooled by passage through heat exchange 72 and passed through valve 52 and into column 200 as reflux. Oxygen-enriched liquid is withdrawn from the lower portion of column 100 as stream 7, cooled by passage through heat exchanger 73 and then passed through valve 51 and into column 200. Column 200 operates at a pressure less than that of column 100 and generally within the range of from 16 to 25 psia. Main condenser 250 can be the usual thermosyphon unit, or can be a once through liquid flow unit, or can be a downflow liquid flow arrangement.

Within lower pressure column 200 the various feeds into this column are separated by cryogenic rectification into nitrogen-rich vapor and crude liquid oxygen. Nitrogen-rich vapor is withdrawn from the upper portion of column 200 as stream 8, warmed by passage through heat exchangers 72, 73 and 70, and removed from the system as stream 33 which may be released to the atmosphere as waste or may be recovered in whole or in part. Stream 33 will generally have an oxygen concentration within the range of from 0.1 to 2.5 mole percent with the remainder essentially all nitrogen. Crude oxygen liquid, having an oxygen concentration within the range from 50 to 88 mole percent, is withdrawn from the lower portion of second or lower pressure column 200 and passed as stream 10 into the upper portion of side column 300.

Side column 300 operates at a pressure which is similar to that of lower pressure column 200 and generally within the range of from 16 to 25 psia. Within side column 300 the descending crude liquid oxygen is upgraded by cryogenic rectification against upflowing vapor into oxygen product fluid and remaining vapor. The remaining vapor, generally having an oxygen concentration within the range of from 25 to 65 mole percent and a nitrogen concentration within the range of from 30 to 79 mole percent, is passed in stream 13 from the upper portion of side column 300 into lower pressure column 200.

The oxygen product fluid, having an oxygen concentration which exceeds that of the crude oxygen liquid and within the range of from 70 to 99 mole percent, collects as liquid in the lower portion of side column 300 and at least a portion thereof is vaporized by indirect heat exchange against the condensing compressed feed air in bottom reboiler 350 which may be of the conventional thermosyphon type or may be a once through or downflow type unit. This vaporization serves to generate the upflowing vapor for the separation of the crude liquid oxygen within side column 300. The oxygen product fluid may be recovered as gas and/or liquid. Oxygen product gas may be withdrawn from side column 300 as stream 11, warmed by passage through heat exchangers 71 and 70 and recovered as oxygen product gas 34. Oxygen product liquid may be withdrawn from side column 300 as stream 12 passed through valve 53 and recovered as oxygen product liquid 35. The oxygen product fluid will have an oxygen concentration within the range of from 70 to 99 mole percent.

Table 1 lists the results obtained from a computer simulation of the invention carried out using the embodiment illustrated in FIG. 1. The stream numbers in Table 1 correspond to those of FIG. 1. This example of the invention is provided for illustrative purposes and is not intended to be limiting. In this example the higher pressure column comprises 20 theoretical trays, the lower pressure column comprises 22 theoretical trays, and the side column comprises 8 theoretical trays.

TABLE 1

| STREAM NO. | FLOW (lb. mole/hr.) | PRESSURE (psia) | TEMP (°K.) | COMPOSITION (Mole Percent) $N_2$ | Ar | $O_2$ |
|---|---|---|---|---|---|---|
| 1 | 100 | 60 | 289 | 78 | 0.9 | 20.9 |
| 2 | 9.8 | 59.4 | 139 | 78 | 0.9 | 20.9 |
| 3 | 90.2 | 57.4 | 95 | 78 | 0.9 | 20.9 |
| 7 | 62.2 | 55.9 | 94 | 68.5 | 1.2 | 30.3 |
| 10 | 33 | 18.3 | 89 | 13.6 | 3.4 | 83 |
| 11 | 21.3 | 18.4 | 92 | 1.9 | 3.1 | 95 |
| 12 | 0.1 | 18.4 | 92 | 0.5 | 2.1 | 97.4 |
| 13 | 11.6 | 18.3 | 89 | 35.2 | 3.8 | 61 |

In this example the oxygen recovery is 97 percent of the oxygen contained in the feed air. The head pressure required to carry out the cryogenic rectification in this example is only about 64 psia. This is about 18 percent less than the 78 psia which would be required to drive a comparable conventional double column separation, thus demonstrating the advantageous results attainable with the practice of this invention.

Figure 2:
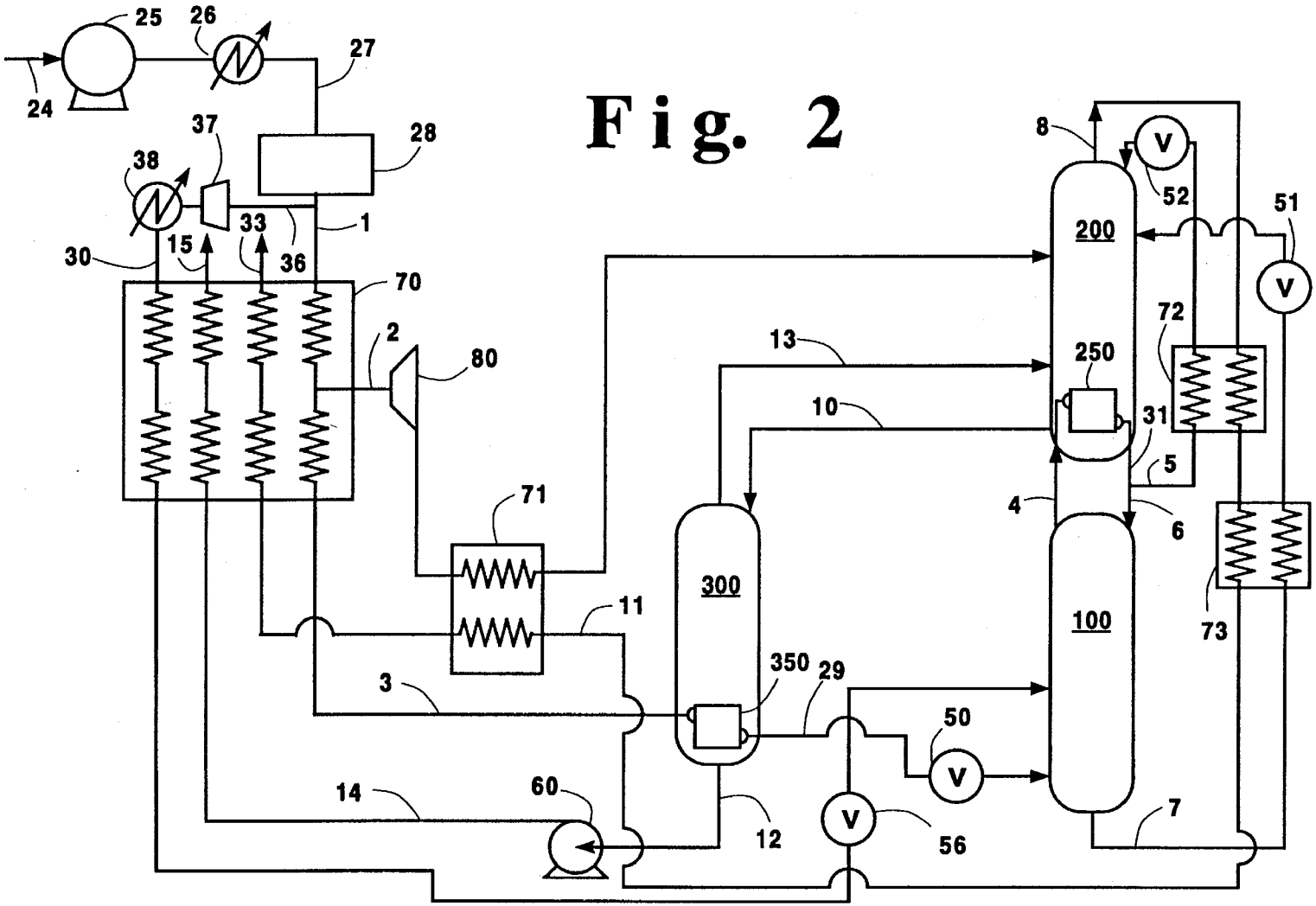
FIG. 2 is a schematic representation of another preferred embodiment of the invention wherein elevated pressure oxygen product may be produced.
Figure 3:
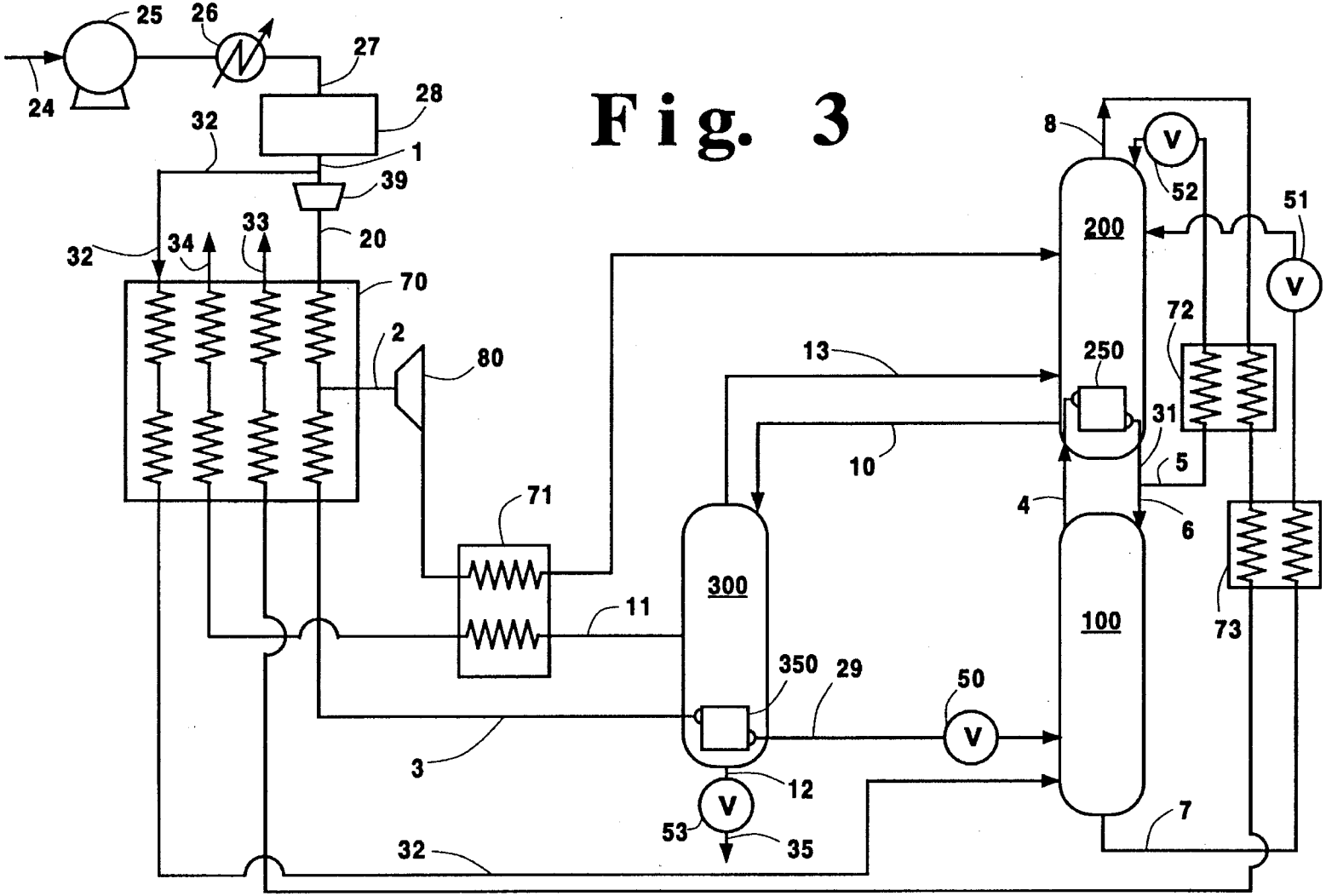
FIG. 3 is a schematic representation of another preferred embodiment of the invention wherein feed air is provided for the higher pressure column at two pressure levels.
Figure 4:
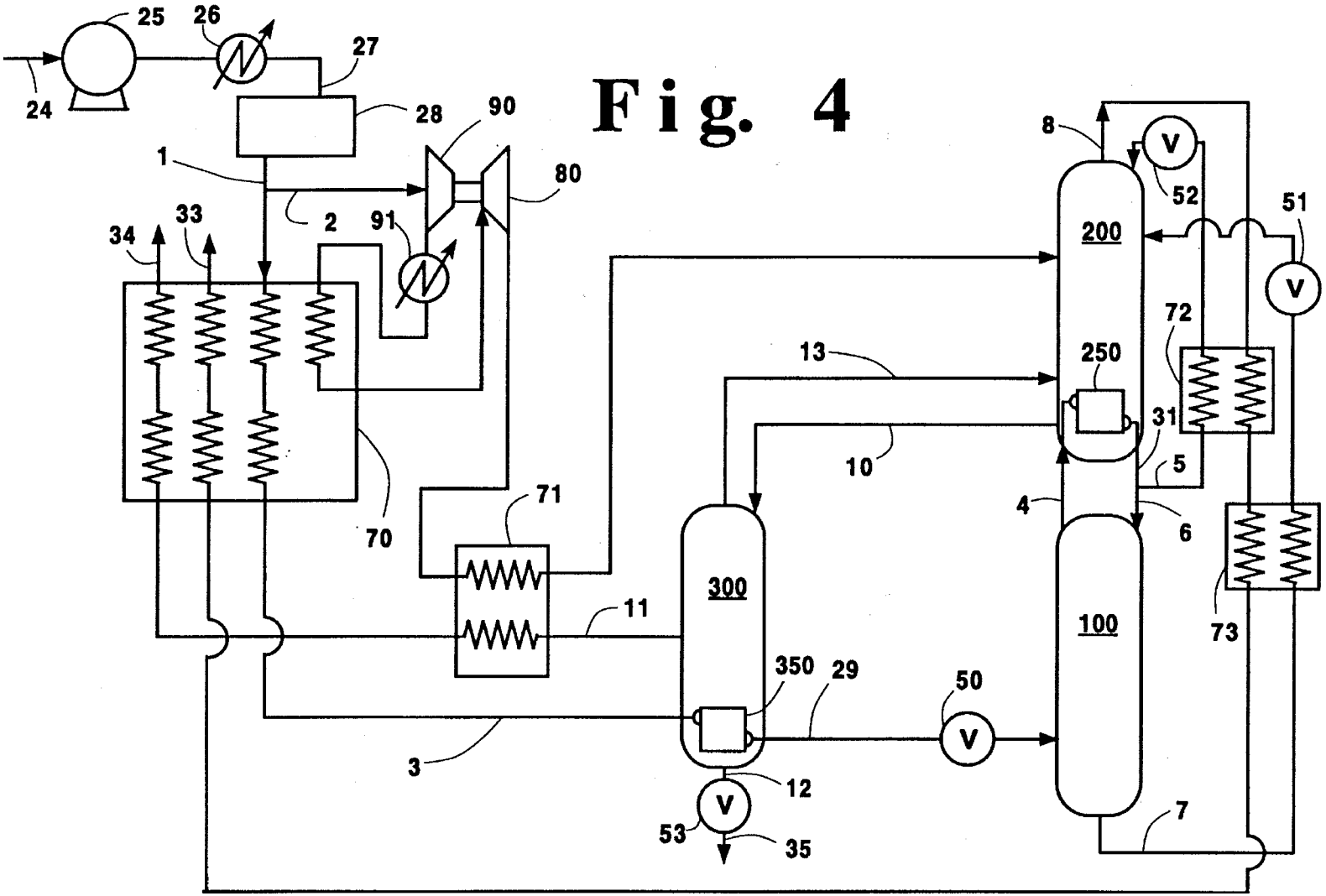
FIG. 4 is a schematic representation of another preferred embodiment of the invention employing a supercharged turbine.

FIGS. 2, 3 and 4 illustrate other preferred embodiments of the invention. The numerals in FIGS. 2, 3 and 4 correspond to those of FIG. 1 for the common elements and these common elements will not be described again in detail.

Referring now to FIG. 2, a portion 36 of feed air stream 1 is further compressed through compressor 37, cooled of heat of compression through cooler 38 and passed as stream 30 through main heat exchanger 70 and valve 56 into higher pressure column 100 at a point above the point where feed air stream 29 is passed into column 100. Oxygen product liquid stream 12 is increased in pressure by means of liquid pump 60 and pressurized liquid stream 14 is vaporized by passage through main heat exchanger 70 to produce elevated pressure lower purity oxygen product gas stream 15. Generally the elevated pressure oxygen product gas will have a pressure within the range of from 30 to 300 psia. Depending upon the heat exchanger design requirements, it may be preferred that the boiling of stream 14 against condensing stream 30 be carried out in a separate heat exchanger (not shown) located between liquid pump 60 and main heat exchanger 70.

In the embodiment illustrated in FIG. 3, a portion 20 of feed air stream 1 is further compressed through compressor 39 prior to passage through main heat exchanger 70 and bottom reboiler 350, while the remaining portion 32 of the feed air stream passes through main heat exchanger 70 but bypasses bottom reboiler 350 and is passed directly into column 100. This embodiment enables one to more easily totally condense the feed air passing through bottom reboiler 350 and is advantageous when producing oxygen product having an oxygen purity within the range of from 90 to 99 mole percent.

In the embodiment illustrated in FIG. 4, feed air portion 2 is taken from stream 1 upstream of main heat exchanger 70 and compressed through compressor 90. The resulting stream is cooled through cooler 91 to remove heat of compression and passed partially through main heat exchanger 70. Thereafter the stream is turboexpanded through turboexpander 80 to generate refrigeration and from there is passed through heat exchanger 71 and into lower pressure column 200. Turboexpander 80 is directly coupled to compressor 90 serving to drive compressor 90 with energy released by the expansion of pressurized gas stream 2 through turboexpander 80. This embodiment is advantageous from an equipment standpoint and can also be useful for producing oxygen product having an oxygen purity within the range of from 90 to 99 mole percent.

Now by the use of this invention one may employ a double column to effectively produce lower purity oxygen while operating at lower pressures and thus with reduced costs that would be necessary with a conventional double column system. Although the invention has been described in detail with reference to certain preferred embodiments, those skilled in the art will recognize that there are other embodiments of the invention within the spirit and the scope of the claims.

I claim:

1. A cryogenic rectification method for producing lower purity oxygen comprising:

(A) compressing feed air;

(B) at least partially condensing compressed feed air and passing the resulting feed air into the higher pressure column of a double column which also includes a lower pressure column;

(C) passing crude liquid oxygen comprising from 50 to 88 mole percent oxygen from the lower pressure column into a side column;

(D) separating the crude liquid oxygen by cryogenic rectification within the side column into oxygen product fluid and remaining vapor;

(E) passing remaining vapor from the side column into the lower pressure column;

(F) at least partially vaporizing the oxygen product fluid by indirect heat exchange with the compressed feed air to carry out the said at least partial condensation of the compressed feed air; and (G) recovering oxygen product fluid as product lower purity oxygen having an oxygen concentration which exceeds that of the crude liquid oxygen.

2. The method of claim 1 wherein the oxygen product fluid is recovered as gas.

3. The method of claim 1 wherein the oxygen product fluid is recovered as liquid.

4. The method of claim 1 wherein oxygen product fluid is withdrawn from the side column as liquid, increased in pressure, and vaporized prior to recovery.

5. The method of claim 1 further comprising turboexpanding a portion of the compressed feed air and passing the turboexpanded feed air into the lower pressure column.

6. A cryogenic rectification apparatus comprising:

(A) a base load feed air compressor, (B) a side column having a bottom reboiler;

(C) a double column including a first column and a second column;

(D) means for passing feed air from the base load feed air compressor to the bottom reboiler and from the bottom reboiler into the first column;

(E) means for passing fluid from the lower portion of the second column into the side column;

(F) means for passing fluid from the side column into the second column; and (G) means for recovering product from the side column.

7. The apparatus of claim 6 wherein the means for recovering product from the side column includes a liquid pump.

8. The apparatus of claim 6 further comprising a turboexpander, means for passing feed air to the turboexpander, and means for passing feed air from the turboexpander into the second column.

9. The apparatus of claim 8 further comprising a compressor directly coupled to the turboexpander, wherein the means for passing feed air to the turboexpander comprises conduit means from the said directly coupled compressor to the turboexpander.

* * * * *